US005296079A

United States Patent [19]

Romo

[11] Patent Number: 5,296,079

[45] Date of Patent: Mar. 22, 1994

[54] APPARATUS FOR PROVIDING LUGGAGE WITH A DISPOSABLE PROTECTIVE COVER

[76] Inventor: Ernesto S. Romo, 4926 N. Maywood Ave., #4, Eagle Rock, Calif. 90041

[21] Appl. No.: 716,211

[22] Filed: Jun. 17, 1991

[51] Int. Cl.[5] ..... B32B 31/00

[52] U.S. Cl. ..... 156/475; 156/213; 156/215; 156/579; 53/587

[58] Field of Search ..... 156/213, 215, 475, 443, 156/579, DIG. 4, DIG. 13, DIG. 26; 53/587, 211, 588, 589, 591, 214

[56] References Cited

U.S. PATENT DOCUMENTS 4,299,076 11/1981 Humphrey ..... 53/587
4,300,326 11/1981 Stackhouse ..... 53/587 X
4,300,975 11/1981 Scott ..... 156/DIG. 26
4,502,264 3/1985 Flaherty ..... 53/587 X
4,783,950 11/1988 Santagati ..... 53/466 X
4,821,486 4/1989 Oiestad ..... 53/587 X
4,917,008 4/1990 van den Wildenberg ..... 53/211 X
4,944,830 7/1990 Zodrow et al. ..... 156/DIG. 26
5,131,209 7/1992 Schreiber et al. ..... 53/587 X
5,168,691 12/1992 Errani ..... 53/587

*Primary Examiner*—Michael W. Ball
*Assistant Examiner*—Michele K. Yoder
*Attorney, Agent, or Firm*—Spensley Horn Jubas & Lubitz

[57] ABSTRACT

A luggage case is provided with a removable protective covering for wrapping a first length of plastic sheeting from a dispenser (80) in one direction and a further length in a direction at 90 degrees to the first direction. The sheeting covering the case handle and wheels is cut away to enable manual use of the case. Apparatus for use in providing the protective covering includes a rotatable pedestal on which the case rests and clamping plate assembly vertically positionable to releasably secure the case to the pedestal during wrapping.

16 Claims, 4 Drawing Sheets

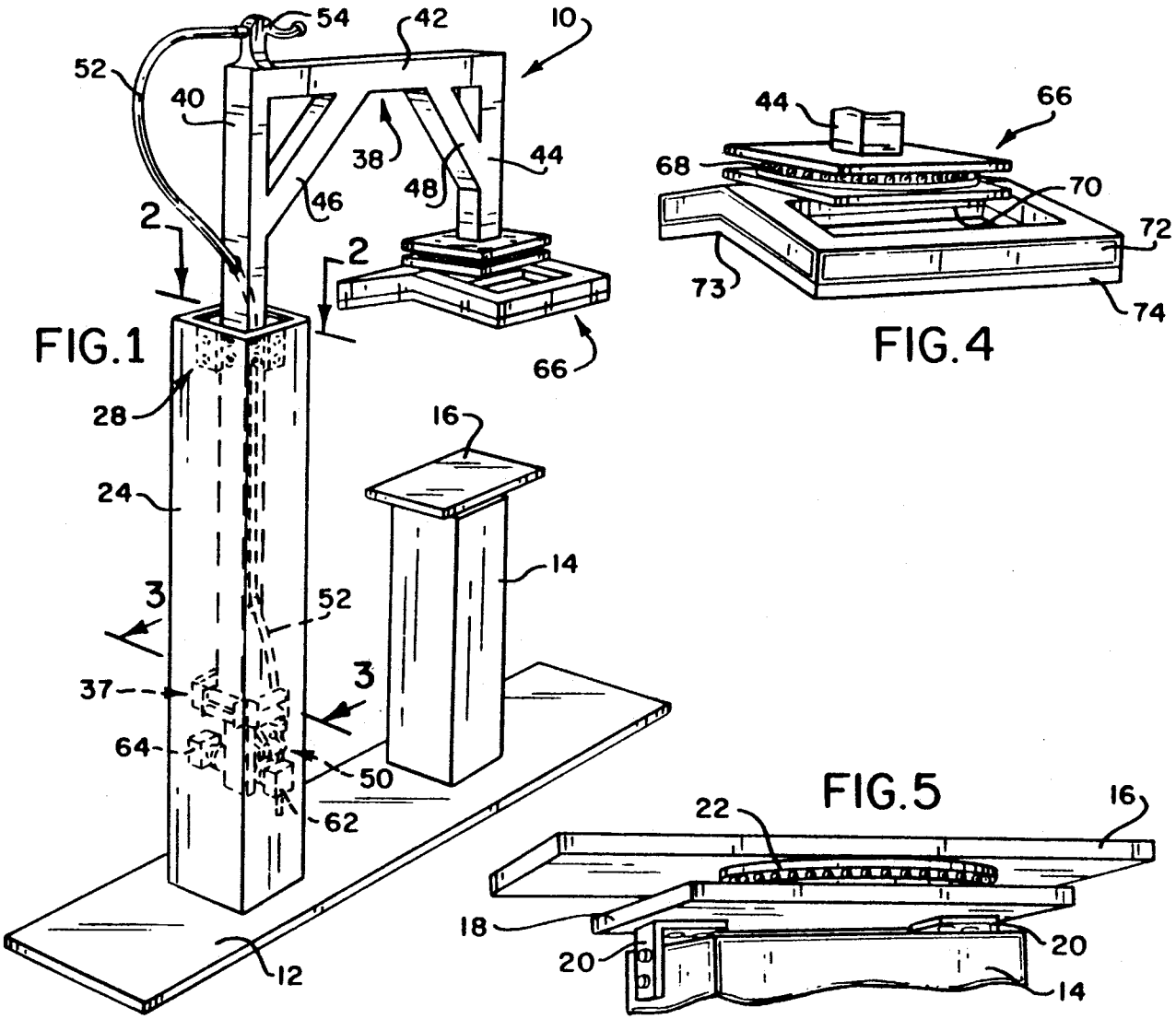
FIG. 1
FIG. 4
FIG. 5
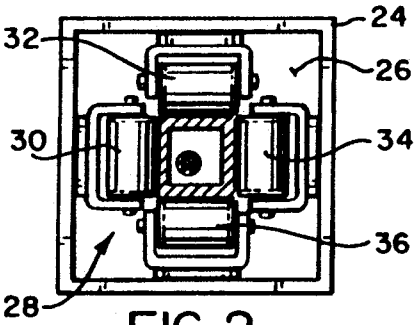
FIG. 2
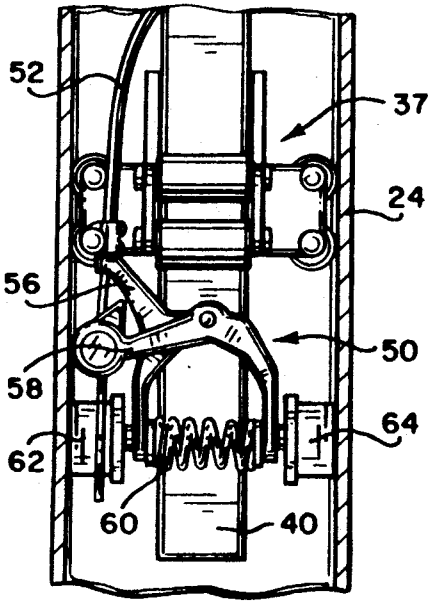
FIG. 3

APPARATUS FOR PROVIDING LUGGAGE WITH A DISPOSABLE PROTECTIVE COVER

BACKGROUND

1. Field of the Invention

The present invention relates generally to the provision of a disposable protective covering for luggage in a relatively simple and inexpensive manner.

2. Related Art

It is common experience in air and train travel to find that luggage has its outer surface scratched, scarred, or otherwise damaged, during transit. This comes about in that the luggage is usually, except for a few smaller items, retained by the transportation facilities for common shipment in which the luggage is moved along conveyor belts and onto special motorized carts for transportation from a reception facility to a plane or train and back, all of which, of course, exposes the luggage to contact with other luggage and the environment so that there is a high risk of damage resulting to the luggage outer surface. It is a desideratum, therefore, to provide an inexpensive throw-away or disposable outer covering for luggage items which can be easily and quickly applied, and which will protect it from damage during transit or storage.

SUMMARY OF THE INVENTION

It is a fundamental contemplation of the present invention to provide apparatus for practicing method to be described herein at entrance locations to transportation facilities such as airports and train stations. That is, since the luggage is, for the most part, taken from the traveler immediately upon arriving at the transportation facility, it is advisable to have apparatus located at that point where the luggage is relinquished (e.g., at checkin stations).

The apparatus is of unitary construction which can be readily moved from one location to another as needed or desired making it effective for protectively covering luggage at first one location when needed and then moved to a second location as the transportation traffic pattern changes. Also, the apparatus has overall weight and dimensions so that it may be used on the sidewalk areas immediately adjacent entrance doors at an airport, for example.

The apparatus has a base plate upon which all of the various apparatus components to be described are mounted. A pedestal is provided with a rotatably mounted support plate for receiving luggage in a resting disposition while a protective covering is applied. Also based on the base plate is an upstanding stanchion located spaced from the pedestal and including a clamping plate and frame connected thereto, which frame is slidingly received within the stanchion in order to position the clamping plate vertically at any desired location above the pedestal. A manually operated brake is affixed to the frame which, upon release, allows the clamping plate to be moved downwardly at a regulated rate.

In practicing the method of the invention on the described apparatus, a large rubber band is stretched about the luggage top, bottom and end walls after which the luggage is placed on the pedestal with the flat bottom downward so that it can rest stably thereon. The operator then releases the brake allowing the clamping plate to descend and clampingly engage the top surface of the luggage. With the luggage clamped between the pressure plate and the pedestal, the brake is then set to maintain retention of the luggage. Now, plastic wrap has one end placed about the rubber band and at least one layer is wrapped around the luggage in a direction parallel to the base plate and sealed over the first end portion of the wrap. The brake is released and the clamping plate raised to enable reorienting the partially wrapped luggage case to a position at 90° to its first position. The brake is then released and the pressure plate once more moved down to clampingly engage the partially protected luggage. A further plastic wrap is applied at 90° to the direction of the initial wrap so as to completely enclose the luggage within plastic wrap. As a final step, with a suitable sharp instrument such as a knife or scissors, the handle is freed for use as well as wheels, if there are any on the luggage. Now the protected luggage can be taken by the skycap or the traveler and given to the transportation checkin employees for handling in the normal manner being confident that the plastic wrap will protect the luggage from surface marking damage throughout handling and storage.

When the trip is completed, the protective wrapping is simply removed by use of a knife or a pair of scissors. Such wrapping removing instruments may be provided at the baggage claim area, for example, as a service on the part of the transportation facilities.

As an alternative to using a rubber band to initially hold the plastic wrap, one or more strips of tape may be applied to the wrap edge and adjacent luggage surface.

DESCRIPTION OF THE DRAWING

In the accompanying drawing:

FIG. 1 is a perspective view of the apparatus of the present invention utilized for protectively wrapping a luggage piece;

FIG. 2 is a top plan sectional view taken along the line 2—2 of FIG. 1;

FIG. 3 is a side elevational sectional view taken along the line 3—3 of FIG. 2;

FIG. 4 is an enlarged partially fragmentary perspective view of a clamping plate;

FIG. 5 is an enlarged perspective view of the luggage support plate;

DESCRIPTION OF PREFERRED EMBODIMENTS

Figure 6:
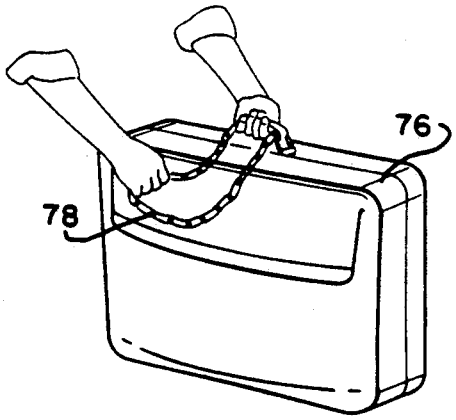
FIGS. 6 and 7 show initial steps of locating an elastic loop around a luggage case in preparation of practicing the method.

Turning now to the drawings and particularly FIG. 1, the apparatus for use in practicing the method of the present invention for providing a disposable protective wrapping on a luggage case is enumerated generally as 10. The entire apparatus is unitarily mounted onto the upper surface of a generally rectangular base plate 12 contemplated for resting receipt on a horizontal ground plane such as a sidewalk, floor, or mobile cart, for example. Adjacent an edge of the base plate is a vertically upstanding pedestal 14 securely mounted to the baseplate and having at its upper end a rotatably mounted luggage support plate 16. More particularly, the plate 16 is mounted onto a further plate 18 secured to the top end of the pedestal by a plurality of L-shaped brackets 20 by bolts or other suitable fastening means. The two plates 16 and 18 are interrelated by a bearing race 22 enabling rotation of the support plate 16 in a horizontal plane throughout 360° (FIG. 5). Preferably, the plate 16 is made from or covered with a soft resilient material such as rubber or synthetic plastic, to prevent marring of luggage during use.

Also mounted on the base plate at a point spaced from the pedestal 14 is a stanchion 24 extending vertically, the upper end of which is higher than that of the pedestal. Specifically, the lower end of the stanchion is affixed securely to the base plate 12 and has a rectangular cross-section with an internal cavity 26 of similar geometry extending substantially throughout the entire length of the stanchion which opens to the exterior at the top end.

Adjacent the upper end of the stanchion cavity 26, there is a journal 28 consisting of four rollers 30, 32, 34 and 36 mounted individually to the respective inner wall surfaces of the stanchion cavity 26 with the roller axes of rotation all being parallel to one another and presenting facing roller surfaces defining a generally rectangular bearing contacting surface.

A clamping frame 38 is generally U-shaped with a first elongated arm 40, a cross bar 42 and a second elongated arm parallel to the first arm but shorter. The two arms 40, 44 and crossbar 42 are in unitary relation and all lie in substantially the same plane. Trusses or struts 46 and 48 extend between the cross bar and the respective arms 40 and 44 to strengthen the structure. The long arm 40 has a rectangular cross section of dimensions enabling it to be slidingly received within the stanchion cavity and the journal 28 The frame 38 is so dimensioned and the stanchion is so positioned relative to the pedestal that the second shorter arm 44 is vertically aligned with the pedestal axis.

A further journal 37, of construction similar to journal 28, is mounted on arm 40 adjacent the lower end thereof and presents its rollers for contacting the inner surfaces of the stanchion. By the coaction of the two journals 28 and 37 the frame arm 40 is maintained on a path of movement normal to the base plate 12.

As can be seen best in FIG. 3, the lower end of the arm 40 which extends below the further journal 37 includes a brake 50 which is controlled by an elongated flexible mechanical actuator 52 extending upwardly within the arm 40 and then outwardly for interconnection with a hand-grip operator 54 affixed to the topmost part of the clamping frame 38 adjacent the interconnection of the crossbar with the arm 40. More particularly, the brake 50 includes a pair of pivotally related yoke arms 56 and 58 which are resiliently extended by a coil spring 60 to force brake pads 62 and 64 against the inner surface of two opposite walls of the stanchion. In the normal relaxed position, the brake secures the frame against vertical movement. When it is desired to reposition the frame 38, manipulation of the hand-grip operator 54 moves the pads 62 and 64 away from contact with the stanchion inner walls allowing frame adjustment as desired.

Affixed to the lower end of the second arm 44 is a luggage clamping plate assembly 66 which is used to contact and secure the luggage in place while it is resting on the pedestal during application of the protective coating in accordance with this invention. The plate assembly includes generally a journal 68 affixed to the lower end of the arm 44 and a clamping plate 70, the latter being rotatably secured to the arm 44 via the journal 68. The clamping plate 70 includes a generally rectangular frame 72 which is formed out of the flat condition about a central axis 73 so that when viewed from the side it is slightly triangular with a concave lower surface. Affixed to the lower surface of the clamping plate 70 is a layer 74 of a resilient material such as rubber or soft plastic, for example. The top surface of the clamping plate is secured to the journal 68 thereby enabling the clamping plate and resilient layer to rotate with respect to the frame arm 44 as a unit.

Figure 7:
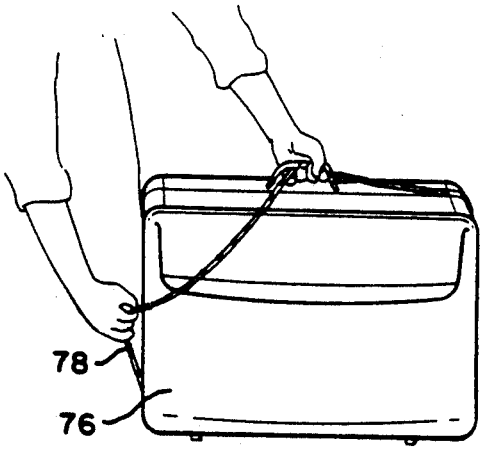
Figure 8:
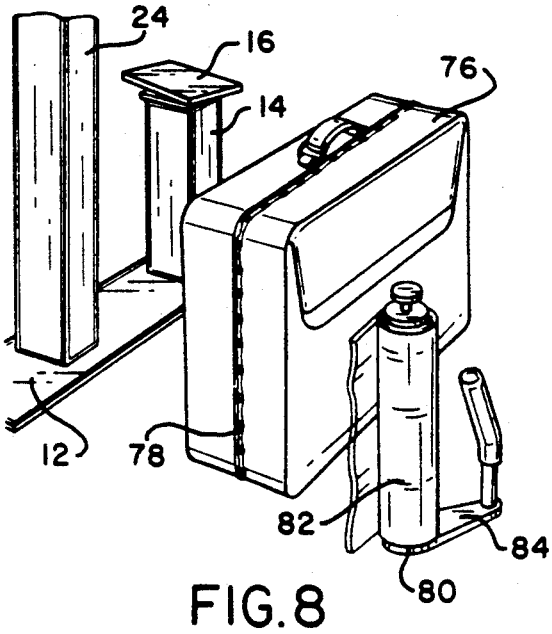
FIG. 8 shows the luggage with an elastic loop in place located immediately adjacent the apparatus.
Figure 9:
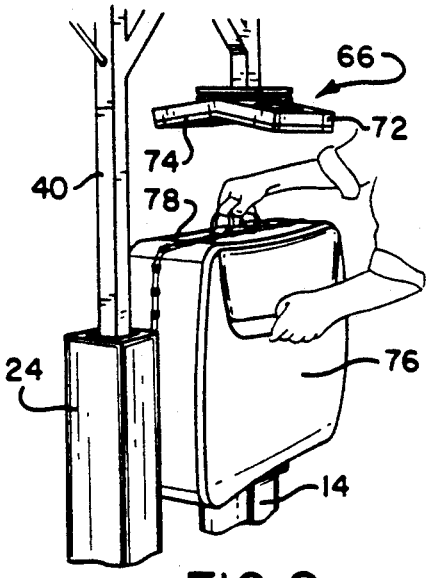
FIG. 9 shows the luggage being placed on the apparatus pedestal.
Figure 10:
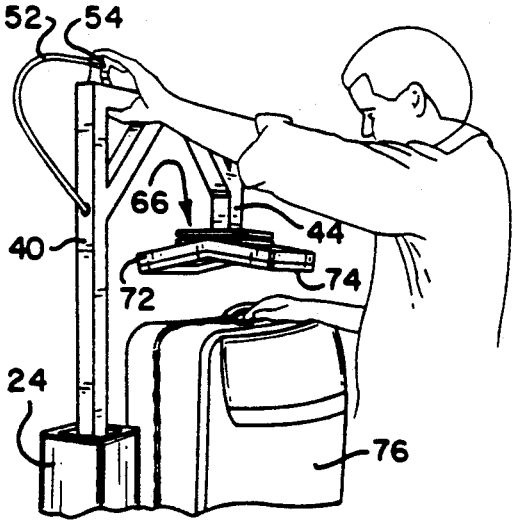
FIGS. 10 and 11 show the luggage being secured in place on the apparatus preliminary to applying a protective wrap.
Figure 11:
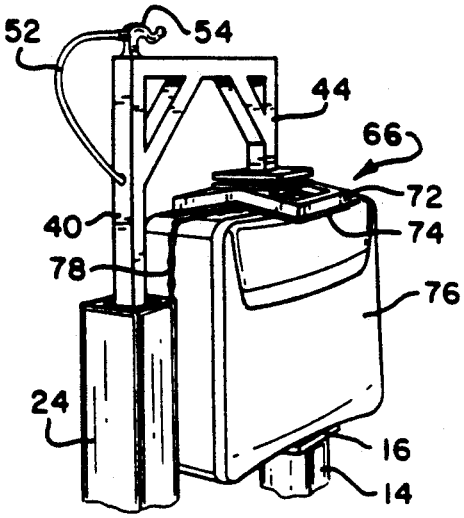

As initial preparation of a luggage case 76 for practicing the method of this invention, a closed loop elastic member 78 (e.g., rubber band) is stretched onto the luggage case so as to extend about the bottom, top and two end walls (FIGS. 6–8). Next, the luggage is restingly located on the pedestal support plate 16 (FIG. 9), the frame brake is released by manipulation of the hand-grip operator 54 (FIG. 10), and the frame is moved downwardly until the clamping plate assembly securely clamps against the luggage case top with the concave lower surface of the backplate 72 and resilient soft layer 74 conforming somewhat to the case top wall (FIG. 11).

In accordance with one embodiment, a source of supply or dispenser 80 of plastic sheeting is a roll 82 which is mounted on a baseplate 84 including a handle. The important aspects of such a source of supply is that it must be light weight and configured so that the sheeting can be readily pulled off horizontally.

Figure 12:
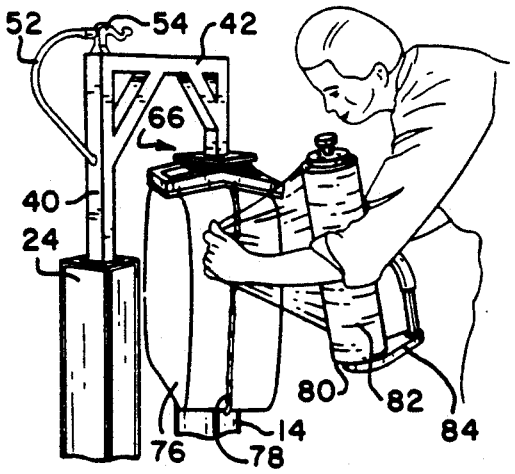
FIGS. 12, 13 and 14 show the steps of applying a protective wrap about the luggage in one plane.
Figure 13:
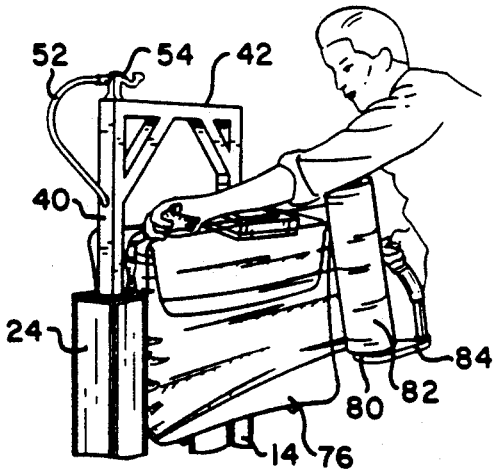
Figure 14:
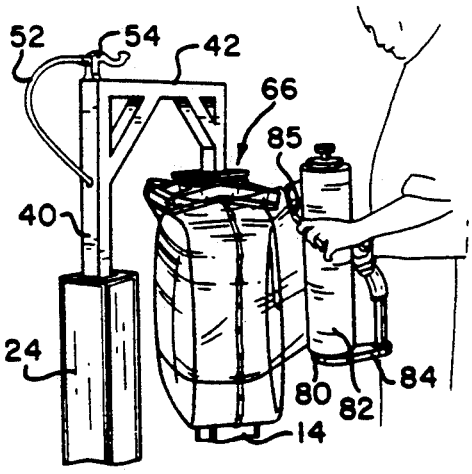

As a first step for application of the plastic sheeting as a protective coating, an end portion of the plastic sheeting is located about the elastic member 78 on an endwall of the luggage case (FIG. 12). The sheeting is now wound about the luggage case one or more times by turning the case with one hand while holding the dispenser with the other (FIGS. 12–14). When the front, back and two endwalls are covered, the sheeting is cut from the dispenser by use of a knife 85, for example (FIG. 14).

Figure 15:
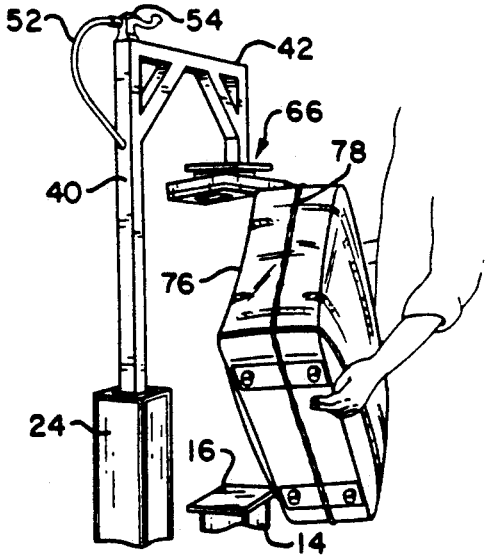
FIGS. 15, 16, 17 and 18 depict rotating the luggage case with protective wrap in one plane to a new position and applying a further protective wrap at 90° to the original wrap.
Figure 16:
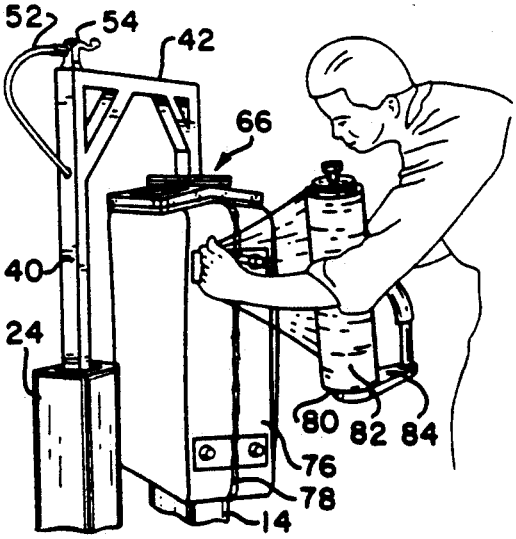
Figure 17:
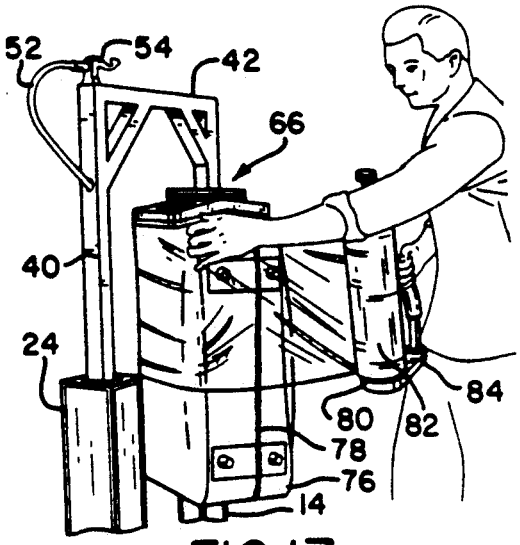
Figure 18:
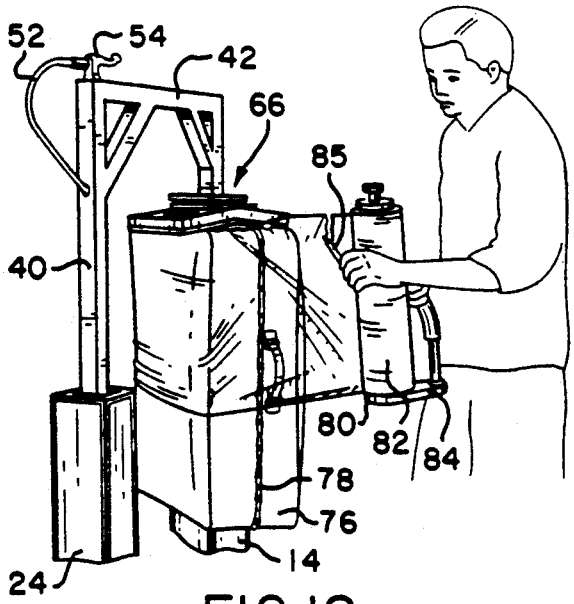
Figure 19:
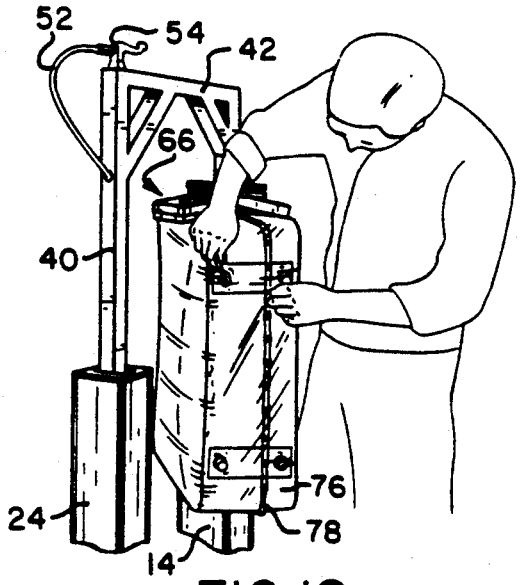
FIGS. 19 and 20 show removing protective wrap from wheels, rollers and handle of the luggage case.
Figure 20:
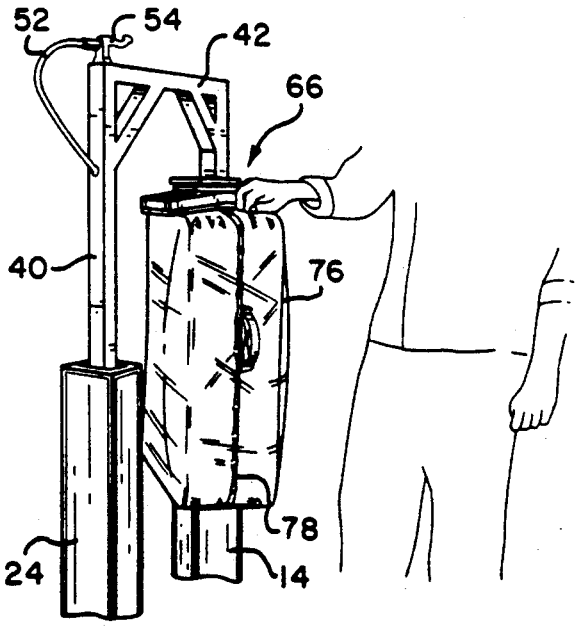

The brake is then released and the luggage case is rotated so that it rests on an endwall (FIGS. 15 and 16). The brake grip control 54 is then manipulated so that the opposite endwall is contactingly engaged by the clamping plate assembly (FIG. 16). Now, one or more layers of protective plastic sheeting are wrapped at 90° to the first wrapping, i.e., about the bottom, top, front and rear side panels (FIGS. 16 and 17). Lastly, the sheeting is cut away from the supply roll (FIG. 18) and also cut away from the handle and wheels, if any (FIGS. 19 and 20). The brake is then released and the protectively covered luggage case removed.

Many types of plastic sheeting will adhere to itself rather strongly so that the last edge portion adjacent the line of severance from the supply roll may merely be pressed by hand against the underlying sheeting and it will adhere. However, other types of plastic may require the use of one or several short pieces of an adhesive tape to insure retention of the outer plastic sheeting layer.

Figure 21:
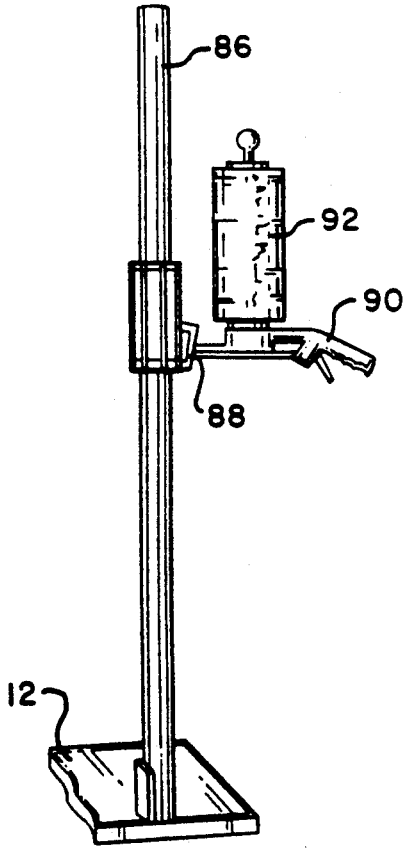
FIG. 21 is a side elevational view of an alternate embodiment of protective wrap supply spool supporting apparatus.

In FIG. 21 there is shown an alternative means for dispensing plastic sheeting which will be especially advantageous for quickly accommodating to luggage cases of different sizes. A vertical rod 86 can be fastened or otherwise connected to the outer end of the baseplate 12 adjacent the pedestal. A variable positioned support means 88 is secured to the rod and can be moved up or down by manipulation of the grip 90 to a new position. In this way, plastic sheeting taken from a supply roll 92 carried by means 88 can be quickly and easily located at any convenient height.

Although the invention has been described in connection with a preferred embodiment, it is to be understood that those skilled in the appertaining art may make modifications which come within the spirit of the invention and the ambit of the claims that follow.

What is claimed is:

1. Apparatus for relatively holding a luggage case having a top surface while lengths of plastic sheeting are wrapped about said luggage case, comprising:

rotatable luggage case support means for rotatively supporting the luggage case;

clamping frame means for adjustable vertical positioning;

a clamping plate assembly secured to the clamping frame means for vertical movement above and aligned with the luggage case support means for clampingly engaging a luggage case while the luggage case is supported by the luggage case support means; and means for securing an end portion of the plastic sheeting to the luggage case while the luggage case is rotated to wrap the plastic sheeting about the luggage case;

wherein the clamping plate assembly comprises a frame defining a generally inverted "V" shaped clamping surface operable to contact the top surface of the luggage case and having a surface portion which extends below the horizontal plane at the top surface of the luggage case for increasing the stability of the luggage case while clamping the luggage case between the clamping surface of the frame and the luggage case support means upon the luggage case being supported by the luggage case support means.

2. Apparatus as in claim 1, in which the luggage case support means includes a pedestal having an upper end and a plate rotatably mounted on the upper end of the pedestal, the plate providing a generally horizontal surface.

3. Apparatus as in claim 1, in which the first side arm is journaled within the generally hollow stanchion; and there is provided a brake selectively interrelating the stanchion and first side arm, and a grip actuator mounted on the frame crossbar for actuating the brake to either the braking or release mode.

4. Apparatus as in claim 1, in which the plastic sheeting is taken off a hand-held roll of plastic sheeting.

5. Apparatus as in claim 1, further comprising a base to which the luggage case support means is coupled and a vertical rod fixed to the base adjacent the luggage case support means, sheeting support means selectively positionable along the vertical rod, and a supply roll of plastic sheeting carried by the sheeting support means from which said lengths of plastic sheeting are taken.

6. Apparatus for rotatively holding a luggage case while lengths of sheeting are wrapped about said luggage case, comprising:

a base plate for generally horizontal resting disposition;

rotatable luggage support means for rotatively supporting the luggage case, the luggage support means being coupled to the base plate;

a generally hollow stanchion coupled to the base plate and extending substantially vertically upward therefrom;

clamping frame assembly having a generally "U"-shaped frame with a crossbar and first and second side arms, the first side arm being received within the generally hollow stanchion and being slidable therein for vertically adjusting the second side arm;

a clamping plate assembly secured to the second side arm of the clamping frame assembly for vertical movement above and aligned with the luggage support means, the clamping plate assembly defining a generally inverted "V" shaped clamping surface for clampingly engaging a luggage case upon the luggage case being supported by the luggage support means; and means for securing an end portion of the plastic sheeting to the luggage case while the luggage case is rotated to wrap the plastic sheeting about the luggage case.

7. Apparatus for holding a luggage case having a bottom surface while plastic sheeting is wrapped about the luggage case, the apparatus comprising:

a luggage support defining a rotatable support surface for rotatably supporting the bottom surface of the luggage case thereon;

a clamping plate assembly aligned with the luggage support, the clamping plate assembly defining a generally inverted "V" shaped clamping surface for clampingly engaging the luggage case while the luggage case is supported on the support surface; and means for securing an end portion of the plastic sheeting to the luggage case while the luggage case is rotated to wrap the plastic sheeting about the luggage case;

wherein the support surface is smaller than the bottom surface of the luggage case in at least one dimension such that the luggage case extends beyond the support surface upon being supported thereon.

8. Apparatus as recited in claim 7, further comprising;

a base;

clamping frame coupled to the based, for vertical movement with respect to the base;

wherein the luggage support comprises a pedestal fixed to the base and a support plate rotatably coupled to the pedestal; and wherein the clamping plate assembly comprises a clamping plate rotatably coupled to the clamping frame, such that vertical movement of the clamping frame with respect to the base provides corresponding vertical movement of the clamping plate with respect to the support plate.

9. Apparatus as recited in claim 8, further comprising:

a stanchion fixed to the base and supporting the clamping frame for vertical movement with respect to the stanchion and base, such that the clamping frame is coupled to the base through the stanchion; and a releasable brake mechanism for selectively braking the vertical movement of the clamping frame with respect to the stanchion and base.

10. Apparatus as recited in claim 7, wherein the luggage case has a side surface, the support surface and clamping plate assembly are adapted to clamp the luggage case therebetween with the side surface of the luggage case resting on the support surface.

11. A user adjustable apparatus for holding a luggage case having top and bottom surfaces while sheeting material is wrapped about the luggage case, the apparatus comprising:

a rotatable luggage support member defining a support surface operable to support the bottom surface of the luggage case for rotation;

a clamping frame movably supported by the stanchion for vertical movement relative to the stanchion;

a brake mechanism interrelating the clamping frame and stanchion, the brake mechanism having a braking mode for inhibiting vertical movement of the clamping frame relative to the stanchion and a brake release mode for allowing vertical movement of the clamping frame relative to the stanchion;

a manually operated brake release mechanism, operably connected to the brake mechanism, for allowing the user to manually place the brake in its release mode to enable the user to manually raise or lower the clamping frame relative to the stanchion; and a clamping plate assembly supported by the clamping frame above and aligned with the support surface, for engaging the top surface of the luggage case when the bottom surface of the luggage case is supported by the support surface;

wherein the height of the clamping plate assembly above the support surface is adjusted by manually raising or lowering the clamping frame relative to the stanchion when the brake is in its release mode.

12. Apparatus as recited in claim 11, wherein the manually operated brake release mechanism includes a manually operated hand grip coupled to the clamping frame.

13. Apparatus as recited in claim 11, wherein:

the stanchion comprises a generally hollow tubular structure; and the clamping frame comprises a first arm slidably received within the generally hollow tubular structure of the stanchion, a second arm coupled to the clamping plate assembly and an interconnecting portion rigidly interconnecting the first and second arms.

14. Apparatus as recited in claim 11 wherein the clamping plate assembly comprises a frame having a generally inverted "V"-shaped surface adapted to partially conform to the top surface of the luggage case for increasing the stability of a luggage case held between the generally inverted "V"-shaped surface of the support surface.

15. Apparatus for wrapping a luggage case having top and bottom surfaces with sheeting material, the apparatus comprising:

a rotatable luggage support member defining a support surface operable to support the bottom surface of the luggage case for rotation;

a clamping plate aligned with the luggage support member, the clamping plate defining a generally inverted "V" shaped clamping surface for engaging the top surface of the luggage case when the bottom surface of the luggage case is supported by the support surface; and a sheeting material support structure for supporting a supply of sheeting material in the proximity of the luggage support member for wrapping about the luggage case as the luggage case is rotated;

wherein the support surface is smaller than the bottom surface of the luggage case in at least one dimension such that the luggage case, upon being supported by the support surface, extends beyond the support surface.

16. Apparatus as recited in claim 15, wherein the luggage case has a side surface, the support surface and clamping plate are adapted to clamp the luggage case therebetween with the side surface of the luggage case resting on the support surface.

* * * * *